US008167084B1

(12) United States Patent
Moore

(10) Patent No.: US 8,167,084 B1
(45) Date of Patent: May 1, 2012

(54) SOUND SUPPRESSOR

(75) Inventor: Charles Moore, Columbia, SC (US)

(73) Assignees: FN Manufacturing, LLC, Columbia, SC (US); F.N. Herstal, SA, Herstal (BE)

( * ) Notice: Subject to any disclaimer, the term of this patent is extended or adjusted under 35 U.S.C. 154(b) by 0 days.

(21) Appl. No.: 13/032,804

(22) Filed: Feb. 23, 2011

Related U.S. Application Data

(60) Provisional application No. 61/309,041, filed on Mar. 1, 2010.

(51) Int. Cl.
*F41A 21/30* (2006.01)

(52) U.S. Cl. ..... 181/223

(58) Field of Classification Search ..... 181/223; 89/14.3, 14.4
See application file for complete search history.

(56) References Cited

U.S. PATENT DOCUMENTS

| | | | |
|---|---|---|---|
| 1,017,003 | A | 2/1912 | Kenney |
| 1,066,898 | A | 7/1913 | Gray |
| 2,375,617 | A | 5/1945 | Bourne |
| 2,503,491 | A | 4/1950 | Janz |
| 2,932,915 | A | 4/1960 | Wilson |
| 3,164,060 | A | 1/1965 | Dahl |
| 3,399,597 | A | 9/1968 | Perrine |
| 3,483,794 | A | 12/1969 | Packard |
| 3,667,570 | A | 6/1972 | WerBell, III |
| 3,748,956 | A | 7/1973 | Hubner |
| 3,948,348 | A | 4/1976 | Bychinsky |
| 4,291,610 | A | 9/1981 | Waiser |
| 4,501,189 | A | 2/1985 | Brandl et al. |
| 4,510,843 | A | 4/1985 | Rabatin |
| 4,530,417 | A | 7/1985 | Daniel |
| 4,576,083 | A | 3/1986 | Seberger, Jr. |
| 4,588,043 | A | 5/1986 | Finn |
| 4,643,073 | A | 2/1987 | Johnson |
| 4,907,488 | A | 3/1990 | Seberger |
| 4,974,489 | A | 12/1990 | Fishbaugh |
| 5,029,512 | A | 7/1991 | Latka |
| 5,036,747 | A | 8/1991 | McClain, III |
| 5,092,223 | A | 3/1992 | Hudson |
| 5,136,923 | A | 8/1992 | Walsh, Jr. |
| 5,164,535 | A | 11/1992 | Leasure |
| 5,685,102 | A | 11/1997 | Latka |
| 6,308,609 | B1 | 10/2001 | Davies |
| 6,374,718 | B1 | 4/2002 | Rescigno et al. |

(Continued)

FOREIGN PATENT DOCUMENTS

| | | |
|---|---|---|
| FR | 981869 | 1/1951 |

(Continued)

*Primary Examiner* — Jeremy Luks
(74) *Attorney, Agent, or Firm* — Michael A. Mann; Nexsen Pruet, LLC

(57) ABSTRACT

A sound suppressor suppresses sound and flash by creating interacting paths of gas. While a first portion of the gas follows a first path through the suppressor, a second portion of the gas is diverted radially from the first path to a second path and then repeatedly made to cross the first path by a series of baffles with alternating radial passages so that the two portions of gas interfere and interact with each other, and therefore quickly give up much of their kinetic energy before they exit the suppressor. Preferably, the baffles defining the second path impart a swirl to the second portion of gas to cause the present suppressor to flush itself of carbon and metal particles. The interaction of the two portions also accelerates completion of combustion of the gas to thereby reduce flash.

18 Claims, 3 Drawing Sheets

U.S. PATENT DOCUMENTS

| | | | | |
|---|---|---|---|---|
| 6,412,389 | B2 | 7/2002 | Fluhr | |
| 6,425,310 | B1 | 7/2002 | Champion | |
| 6,575,074 | B1 | 6/2003 | Gaddini | |
| 6,619,179 | B2 | 9/2003 | Mika | |
| 6,948,415 | B2 | 9/2005 | Matthews et al. | |
| 7,073,426 | B1 * | 7/2006 | White | 89/14.4 |
| 7,143,680 | B2 | 12/2006 | Bender | |
| 7,237,467 | B1 | 7/2007 | Melton | |
| 7,308,967 | B1 | 12/2007 | Hoel | |
| 7,353,740 | B1 | 4/2008 | Hoffman | |
| 7,412,917 | B2 | 8/2008 | Vais | |
| 7,594,464 | B2 | 9/2009 | Dueck | |
| 7,610,992 | B2 | 11/2009 | Brittingham | |
| 2007/0095195 | A1 | 5/2007 | Pango et al. | |
| 2007/0107590 | A1 * | 5/2007 | Silvers | 89/14.4 |
| 2008/0098880 | A1 | 5/2008 | Brugger | |
| 2008/0156183 | A1 | 7/2008 | Brittingham | |
| 2009/0193963 | A1 | 8/2009 | Poulsen | |
| 2010/0163336 | A1 | 7/2010 | Presz, Jr. et al. | |
| 2010/0180759 | A1 | 7/2010 | Petersen | |

FOREIGN PATENT DOCUMENTS

| | | |
|---|---|---|
| WO | WO 8301680 | 5/1983 |
| WO | WO 99/27317 | 6/1999 |
| WO | WO 2009/151428 A2 | 12/2009 |

* cited by examiner

SOUND SUPPRESSOR

PRIORITY CLAIM

Claim is made to the priority benefit of U.S. provisional patent application Ser. No. 61/309,041 filed Mar. 1, 2010, which application is incorporated herein in its entirety by reference.

BACKGROUND OF THE INVENTION

When a firearm is fired, the burning of the powder charge in the metal shell casing provides the pressure force to accelerate the bullet through the barrel. From there, the bullet's kinetic energy speeds it on toward its target. The burning of the charge generates gaseous by-products that not only accelerate the bullet but also carry small particles of unburned powder and metal from the shell casing/bullet. These follow the bullet down the barrel and out the muzzle where, no longer confined, they disperse quickly.

The sound of the firing of the round and the flash of still-burning power at the muzzle give away the information that a firearm has been fired and where that firearm is located. Conversely, reducing the sound and suppressing the flash would help to deaden the sound of the firearm and to conceal the marksman's location.

Most sound suppressors are cylindrical chambers that attach to the muzzle end of the firearm and provide a path for the bullet while restricting the gas. Their effectiveness in sound suppression is limited and they tend to heat up and foul with carbon and metal particles, limiting their useful life. They also add weight to a firearm and alter its ballistic characteristics.

Thus there remains a need for a flash and sound suppressor that mitigates one or more of these problems of the prior art suppressors.

SUMMARY OF THE INVENTION

The present invention is a flash and sound suppressor for use with a firearm. The present suppressor attaches to the muzzle of the firearm and includes a path for a bullet fired from that firearm to pass through the suppressor while managing the supersonic combustion gases to reduce flash and sound.

The present sound suppressor comprises a housing having a major axis and an interior chamber, a first end and an opposing second end. The housing has plural slots formed along its major axis. A muzzle fitting with a central hole is attached to the first end of the cylindrical body, and an end cap, also with a central hole, is attached to the opposing second end of the cylindrical body so that it and the hole of said muzzle fitting are aligned. A blast baffle lies in the interior chamber of the cylindrical body, and, like the end cap and muzzle fitting, also has a hole formed therein and aligned with the holes in the end cap and muzzle fitting. The hole in the blast baffle makes an initial separation of the combustion gases that result from the firing of a round of ammunition into a first portion that passes through that hole and a second portion that moves radially with respect to the hole. Plural baffles are secured in the slots formed in the housing, each of which has a central hole formed in it and a passage formed radial to said central hole for the second portion of combustion gases to pass through. The passage of any one baffle may not be aligned with passage formed in an adjacent baffle so that the second portion of said combustion gases does not pass in a straight line through each passage of each baffle but is urged by the next baffle along a path across that of the first portion of combustion gases so that it interacts with that first portion. The first and said second portions of the combustion gases are slowed and cooled by this interaction.

The suppressor is made by providing a cylindrical housing having a first end and an opposing second end with a major axis running from the first to the second end, forming slots in a portion of the circumference of the housing and inserting baffles into the slots and attaching them to the housing. A hole is formed in a blast baffle, and end cap and a muzzle fitting and these are attached to the housing.

The present device suppresses sound and flash by creating interacting paths of combustion gas. In particular, while a first portion of the gas follows the bullet along a first path through the suppressor, a second portion of the gas is diverted from the first path radially to a second path and then is repeatedly made to cross the first path by a series of baffles so that the two portions of gas interfere with each other turbulently, and therefore quickly give up much of their kinetic energy before they exit the suppressor. Preferably, the baffles defining the second path are such as to impart a flow to the second portion of gas to cause the present suppressor to flush itself of carbon and metal particles. It is believed that the interaction of the two paths also accelerates completion of combustion of the gas so as to reduce flash.

The present suppressor includes a series of baffles having a central hole for the first path and a radial passage that may be a hole or a cutaway portion of the baffle. Each baffle is attached to the suppressor housing through a slot formed in that housing at the appropriate axial and azimuthal location where it can be secured to the housing accurately and easily. The number of baffles, their spacing, and their orientation with respect to each other has an impact on the suppression of sound of the suppressor. The use of slots in the housing to facilitate installation of the baffles and their securement to the housing is a feature of the present suppressor.

A feature of the present suppressor is the use of a series of baffles that have passages formed therein to define the second, serpentine path that crosses the first path repeatedly. This feature makes it possible to use the second portion of the gas to slow the first portion. The sequence of baffles also acts like a heat exchanger, picking heat up from the turbulent gas as the gas slows and cools while transmitting that heat to the baffles and the wall of the suppressor.

Another feature of the present suppressor is the use of baffles to create a self-cleaning swirl of gas within the chamber. The self-cleaning prevents build up of deposits and enables the suppressor to shed heat better and thereby operate effectively longer.

These and other features and their advantages will be apparent to those skilled in the art of flash and sound suppressors for firearms from a careful reading the Detailed Description of Preferred Embodiments, accompanied by the following drawings.

BRIEF DESCRIPTION OF THE DRAWINGS

In the figures.

DETAILED DESCRIPTION OF PREFERRED EMBODIMENTS

The present invention is a sound suppressor for use with a firearm and a method for making same.

Figure 1:
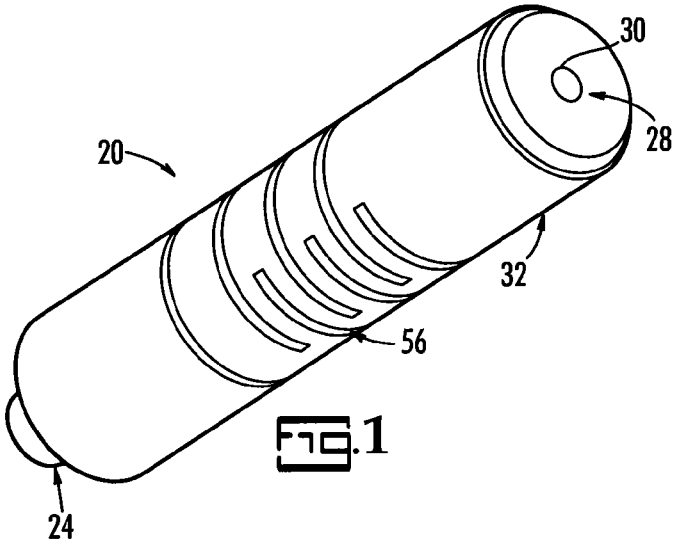
FIG. 1 is a perspective view of a sound suppressor according to a preferred embodiment of the present invention.
Figure 2:
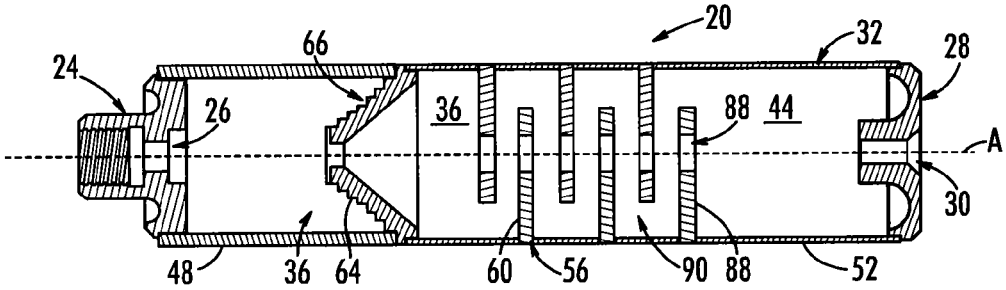
FIG. 2 is a side cross sectional view of the sound suppressor according to an embodiment of the present invention.

Referring now to FIGS. 1 and 2, there is shown a sound suppressor, generally indicated by reference number 20, shown in a perspective exterior view in FIG. 1 and in cross-section from the side in FIG. 2. Suppressor 20 includes a muzzle fitting 24 with nozzle 26 at one end and an end cap 28 with beveled end 30 at the opposing end of a two-part cylindrical housing 32. Muzzle fitting 24 is adapted to be threaded to the end of a barrel of a firearm (not shown) and may be formed as nozzle 26 toward the interior chamber of a first housing segment 48 so as to contribute to the radial dispersion of combustion gases into the chamber of first housing segment 48. If the barrel has a flash hider on the end or other fitting or coupling, muzzle fitting 24 may be modified to attach to such flash hider, fitting or coupling. It is sufficient that muzzle fitting 24 be dimensioned to fit to the end of the firearm and be attachable in such a way that sound suppressor 20 will remain rigidly in place on the end of the barrel so as not to interfere with the trajectory of a bullet fired from the firearm but rather to operate to reduce both sound and flash that result from the fired cartridge.

Housing 32 has an interior 36 having two housing segments, first housing segment 48 and a second housing segment 52. First housing segment 48 may be cylindrical and may be a solid walled cylinder; second housing segment 52 may be formed with plural curved slots 56 in a manner that will be described below but which slots 56 are used to locate and hold baffles 60 which are then secured to second part 52, preferably by welding.

Figure 3:
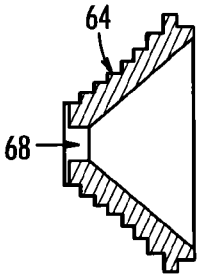
FIGS. 3, 4 and 5 are a side cross-sectional view, an left end view and a right end view of a first embodiment of a blast baffle for a sound suppressor, according to a preferred embodiment of the present invention.
Figure 4:
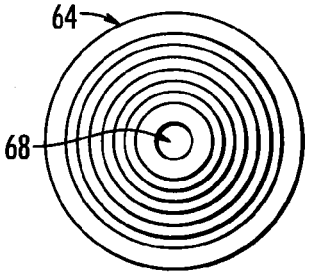
Figure 5:
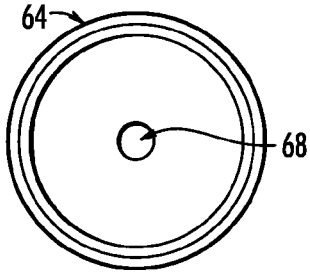
Figure 12:
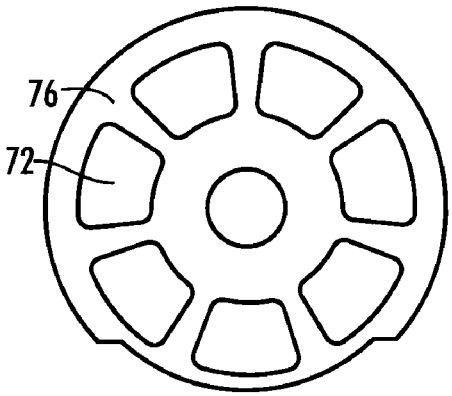
FIG. 12 shows an alternative blast baffle for a sound suppressor, according to a preferred embodiment of the present invention.

Between first housing segment 48 and second housing segment 52 is a blast baffle 64. Blast baffle 64 has a central hole 68 for the bullet to pass there through on its trajectory from the muzzle of the firearm. A first portion of combustion gases will follow the bullet through central hole 68. Blast baffle 64 may be designed to divert a second portion of the combustion gases radially, either to a blind corner 66, as is the case with blast baffle 64 shown in FIGS. 3, 4 and 5, or through holes 72 radial to the center of blast baffle 76 as shown in FIG. 12, or by a diverting surface as in angled blast baffle 80 as shown in the suppressor 84 of FIG. 13. Importantly, blast baffle 64, 76, and 80 initially separate the gas flow into a first and a second portion, reducing the amount of the primary flow that follows the bullet.

Figure 6:
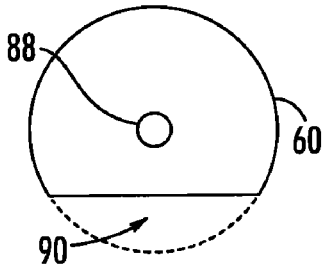
FIG. 6 is an end view of a baffle for a sound suppressor, according to a preferred embodiment of the present invention.
Figure 7:
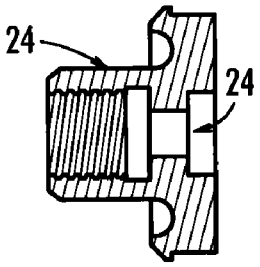
FIG. 7 is a side cross-sectional view of a muzzle fitting for a sound suppressor, according to a preferred embodiment of the present invention.
Figure 8:
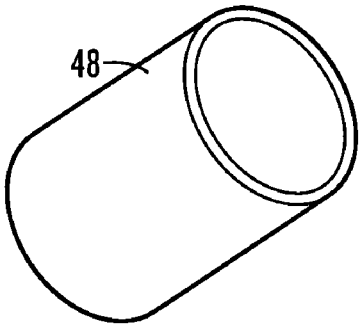
FIG. 8 is a first housing segment for a sound suppressor, according to a preferred embodiment of the present invention.
Figure 9:
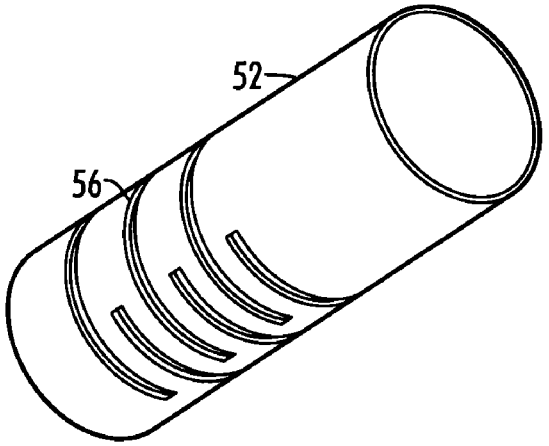
FIG. 9 is a second housing segment for a sound suppressor, according to a preferred embodiment of the present invention.
Figure 10:
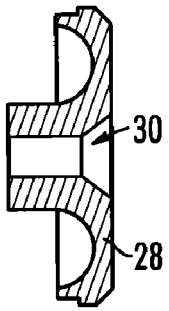
FIGS. 10 and 11 are side cross-sectional and end views of the end cap of a sound suppressor, according to a preferred embodiment of the present invention.
Figure 11:
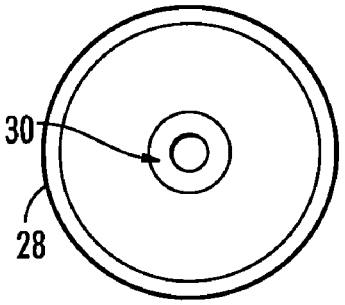

Second housing segment 52 contains the series of baffles 60. See FIGS. 2 and 6. Each baffle 60 has a central hole 88 for the bullet to follow its trajectory, as in the case with blast baffles 64, 76, and 80. In addition, baffles 60 have a passage 90 formed therein radial to central hole 88. Passage 90 may be a hole or a cutaway portion of the circumference of the disk such as a chord-shaped cutaway as illustrated, to provide a crescent-shaped passage 90 for the second portion of combustion gases to continue forward travel ultimately toward end cap 28.

Note that, in the arrangement of baffles 60, the path defined by passage 90 is shown as serpentine, passage 90 being first on one side of second chamber 52 and then on the opposing side, so that the combustion gases are urged to cross and re-cross the major axis A of second housing segment 52, transferring heat to baffles 60 and to second housing segment 52, and interacting with the first portion of combustion gases that follow the path of the bullet through central hole 68 of blast baffle 64 and central holes 88 of baffles 60. Because of this interference, the two portions of gas interact turbulently and the kinetic energy of the first portion is surrendered to baffles 60 and second housing segment 52 as it interacts with the second portion.

In suppressor 20, blast baffle 64 separates the gas flow into its first portion that passes through hole 68 and the second portion that is directed to a blind corner 66. Blast baffle 76 (FIG. 12) includes radial holes 72 to move second portion of combustion gases radially and through holes 72 before second portion arrives at baffles 60. Suppressor 84 (FIG. 13) manages the flow of combustion gases by initially diverting all of first portion by angled baffle 80 in one general radial direction to start them on a serpentine path. By urging the second portion of combustion gases into a longer path around baffles 60, and by forcing portions of combustion gases to interfere with each other, thereby slowing and mixing them, the gases give up heat to reduce their sound and flash. In addition, baffles 60 and the single wall of housing 32 coupled to the baffles 60 through slots 56 cooperate efficiently to exchange heat and to dissipate heat quickly.

Second housing segment 52 is formed with slots 56 into which baffles 60 can be inserted into their correct positions and spacings with respect to each other and then secured in place, such as by welding. The number, locations, spacing and azimuthal orientation of these slots 56 is important as well as the size of passage 90. For example, more slots 56 and therefore more baffles 60 are needed when higher energy ammunition is used. If suppressor 20 is to accommodate 5.56 mm ammunition such as that used in M-16 rifles, six baffles are sufficient; if suppressor 20 is to accommodate 7.62 mm NATO ammunition, eight baffles is sufficient. The spacing between some baffles 60 may be varied to dampen harmonic frequencies that might otherwise occur. Also, flat edges of passages 90 of alternating baffles 60 as shown do not have to be parallel to each other (and do not need to be flat) but may be offset from each other azimuthally to promote swirling and mixing of the first and second portions of combustion gases.

Figure 13:
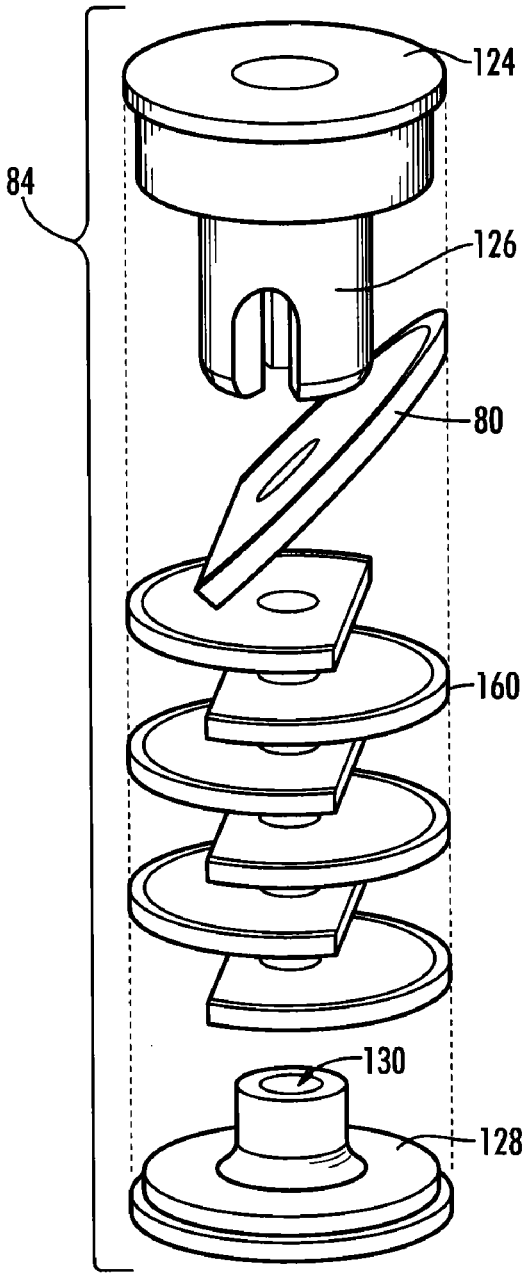
FIG. 13 is a side perspective view of the interior of an alternative sound suppressor showing an alternative muzzle fitting, end cap and blast baffle, according to an embodiment of the present invention.

FIG. 13 illustrates a different set 84 of components for the housing 32 of a suppressor 20, including muzzle fitting 124, end cap 128 and baffles 160 for suppressor 20. Muzzle fitting 124 is formed to accommodate a flash hider 126. End cap 128 may have a beveled hole 130 and be secured permanently to the housing 32. Housing 32 of course requires a slanted slot for blast baffle 80 to be inserted and secured.

End cap 28 has a beveled exit hole 30 for the bullet to pass through. Exit hole 30 may be beveled outward, and may be beveled by less than 20 degrees, preferably no more than 35 degrees and not less than 11 degrees, which helps reduce flash upon the exiting of the bullet and its trailing gases from suppressor 20. While not wishing to be bound by theory, it is believed that the beveling of exit hole 30 disrupts the interaction that would otherwise occur between the high velocity pressure wave of the exiting bullet and the static air to the sides of exit hole 30.

Those familiar with fire arm sound suppressors will appreciate that many modifications and substitutions can be made to the foregoing preferred embodiments of the present invention without departing from the spirit and scope of the present invention, defined by the appended claim.

What is claimed is:

1. A sound suppressor for use with a firearm, comprising:

a housing having a major axis, and exterior and an interior chamber, a first end and an opposing second end, said housing having plural slots formed therein each slot of said plural slots being formed through said housing from said exterior to said interior chamber and curving over a portion of the circumference of said housing along said major axis;

a muzzle fitting attached to said first end of said cylindrical body, said muzzle fitting having a hole formed therein;

an end cap attached to said opposing second end of said cylindrical body, said end cap having a hole formed therein, said hole of said end cap being aligned with said hole of said muzzle fitting;

a blast baffle in said interior chamber of said cylindrical body, said blast baffle having a hole formed therein, said hole of said blast baffle being aligned with said hole of said muzzle fitting, said blast baffle initially separating combustion gases from the firing of a round of ammunition through said hole into a first portion that passes through said hole of said blast baffle and a second portion that moves radially with respect to said hole of said blast baffle; and plural baffles being inserted into said slots from said exterior and attached to said housing, each baffle of said plural baffles having a central hole formed therein and passage formed to include a portion of the circumference of said baffle radial to said central hole, said passage of said each baffle not being aligned with a next passage of an adjacent baffle so that said second portion of said combustion gases does not pass in a straight line through said each passage and said next passage but is urged by said each baffle to interact with said first portion of said combustion gases so that said first and said second portions of said combustion gases are slowed and cooled.

2. The sound suppressor as recited in claim 1, wherein said each baffle is perpendicular to said major axis.

3. The sound suppressor as recited in claim 1, wherein said baffles are not all equally spaced.

4. The sound suppressor as recited in claim 1, wherein said end cap is beveled.

5. The sound suppressor as recited in claim 4, wherein said end cap is beveled not more than by 35 degrees.

6. The sound suppressor as recited in claim 4, wherein said end cap is beveled by at least 11 degrees.

7. The sound suppressor as recited in claim 1, wherein said each passage of said each baffle is arranged to be on an opposing side of said housing with respect to said next passage of said next baffle.

8. The sound suppressor as recited in claim 1, wherein said plural baffles is at least six baffles.

9. A suppressor for use with a firearm made according to a method comprising the steps of:

(a) providing a cylindrical housing having an exterior and an interior chamber, a first end and a second end and a major axis running from said first end to said second end;

(b) forming curved slots through said housing from said exterior to said interior chamber in a portion of the circumference of said housing;

(c) inserting baffles into said slots from said exterior of said housing, said baffles having a central hole and a passage formed in said baffle radial to said central hole and including a portion of the circumference of said baffle;

(d) attaching said baffles to said housing;

(e) forming a hole in a blast baffle;

(f) attaching said blast baffle in said housing;

(g) forming a hole in a muzzle fitting;

(h) attaching said muzzle fitting to said first end of said housing;

(i) forming a hole in an end cap; and (g) attaching said end cap to said second end of said housing.

10. The suppressor as recited in claim 9, further comprising the steps of:

(a) forming a central hole in each baffle of said baffles; and (b) forming a passage in said each baffle radially displaced from said central hole in said each baffle.

11. The suppressor as recited in claim 10, further comprising the step of aligning said central hole of said each baffle with said major axis when said baffles are inserted into said slots.

12. The suppressor as recited in claim 11, further comprising the step of arranging said passage of said each baffle so that it is not aligned with a next passage of a next baffle of said baffles.

13. The suppressor as recited in claim 9, wherein said end cap hole forming step further comprises the step of beveling said hole.

14. The suppressor as recited in claim 9, wherein said beveling step further comprises beveling an at least 11 degree hole in said end cap.

15. The suppressor as recited in claim 9 wherein said cylindrical housing providing step further comprises the steps of:

(a) providing two segments; and, after attaching said blast baffle to said first segment (b) attaching said first segment to said second segment to form said housing.

16. The suppressor as recited in claim 9, wherein said slot forming step further comprises forming said slots at intervals along said major axis of said housing and wherein at least one slot of said slots is at a different spacing from a next slot of said slots.

17. The suppressor as recited in claim 9, further comprising the step of forming at least one radial passage in said blast baffle.

18. The suppressor as recited in claim 9, wherein said slot forming step further comprises the step of forming at least six slots in said housing.

* * * * *